US009123295B2

(12) United States Patent
Jeong

(10) Patent No.: US 9,123,295 B2
(45) Date of Patent: Sep. 1, 2015

(54) METHOD AND APPARATUS FOR CONTROLLING CURRENT OF ORGANIC LIGHT EMITTING DIODE DISPLAY DEVICE

(71) Applicant: LG Display Co., Ltd., Seoul (KR)

(72) Inventor: Jae-Hyeong Jeong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 181 days.

(21) Appl. No.: 13/866,437

(22) Filed: Apr. 19, 2013

(65) Prior Publication Data

US 2014/0152704 A1 Jun. 5, 2014

(30) Foreign Application Priority Data

Nov. 30, 2012 (KR) ..... 10-2012-0138209

(51) Int. Cl.
*G09G 3/32* (2006.01)

(52) U.S. Cl.
CPC ..... *G09G 3/3233* (2013.01)

(58) Field of Classification Search
CPC ..... G09G 3/045; G09G 3/12; G09G 3/2003–3/2081; G09G 3/30–3/3291; G09G 2310/0243–2310/0259; G09G 2310/264–2310/0297; G09G 2320/0233; G09G 2320/0673
USPC ..... 345/36, 45, 76–81; 315/169.3
See application file for complete search history.

(56) References Cited

U.S. PATENT DOCUMENTS

2004/0201582 A1* 10/2004 Mizukoshi et al. ..... 345/211
2008/0037866 A1* 2/2008 Na ..... 382/168
2009/0051714 A1* 2/2009 Ohhara ..... 345/690
2010/0328359 A1* 12/2010 Inoue et al. ..... 345/690
2011/0187754 A1* 8/2011 Yoo ..... 345/690
2011/0254878 A1* 10/2011 Mori et al. ..... 345/690

FOREIGN PATENT DOCUMENTS

CN 101123062 A 2/2008
CN 101422031 A 4/2009
CN 101960508 A 1/2011

OTHER PUBLICATIONS

Office Action for Chinese Patent Application No. CN 201310134462.8, Jul. 2, 2015, 11 pages.

* cited by examiner

*Primary Examiner* — Sanghyuk Park
(74) *Attorney, Agent, or Firm* — Fenwick & West LLP

(57) ABSTRACT

A method and apparatus for controlling current of an organic light emitting diode (OLED) display device, which is able to accurately estimate the amount of current according to an input image and control current to converge upon target current disclosed. The apparatus includes a current controller for estimating a total current value using a peak luminance corresponding to an average picture level of input data and a histogram analysis result of the input data, comparing an estimated total current value and a target value to generate a luminance control gain, feeding the luminance control gain back and repeatedly performing an operation for estimating the total current value and generating the luminance control gain to determine a final luminance control gain, and applying the final luminance control gain to the peak luminance to determine a final peak luminance, a gamma voltage generator, and a data driver.

16 Claims, 8 Drawing Sheets

METHOD AND APPARATUS FOR CONTROLLING CURRENT OF ORGANIC LIGHT EMITTING DIODE DISPLAY DEVICE

CROSS-REFERENCE TO RELATED APPLICATIONS

This application claims the benefit of Korean Patent Application No. 10-2012-0138209, filed on Nov. 30, 2012, which is hereby incorporated by reference as if fully set forth herein.

BACKGROUND

1. Field of Technology

The present invention relates to an organic light emitting diode (OLED) display device, and more particularly, to a method and apparatus for controlling current of an OLED display device, which is able to accurately estimate the amount of current according to an input image and control current to converge upon a target current.

2. Discussion of the Related Art

An OLED display device is a self-emissive device for emitting light using an organic light emitting layer due to re-combination between electrons and holes and is expected to be a next-generation display device due to high luminance, low driving voltage and slimness of the OLED display device.

Each of a plurality of pixels (subpixels) configuring an OLED display device includes an OLED element including an organic light emitting layer between an anode and a cathode and a pixel circuit for independently driving the OLED element. The pixel circuit includes at least a switching transistor, a storage capacitor and a driving transistor. The switching transistor charges the storage capacitor with a voltage corresponding to a data signal in response to a scan pulse and the driving transistor controls current supplied to the OLED element according to the voltage charged in the storage capacitor so as to adjust the amount of light emitted by the OLED element. The amount of light emitted by the OLED element is proportional to current supplied from the driving transistor.

In order to reduce power consumption, a conventional OLED display device generally uses a method of controlling current by controlling a peak luminance, that is, a method of controlling current of a display panel by controlling a peak luminance (maximum white luminance) according to an input image so as to adjust a gamma voltage.

In the conventional OLED display device, a peak luminance is controlled by estimating the amount of current on the assumption that the amount of current is linearly proportional to luminance. However, actually, in the OLED display device, since the amount of current is non-linearly proportional to luminance, it is difficult to accurately estimate the amount of current according to the input image. Therefore, since a difference between an estimated current value and a target current occurs, it is difficult to accurately control current.

SUMMARY

Accordingly, the present invention is directed to a method and apparatus for controlling current of an OLED display device that substantially obviates one or more problems due to limitations and disadvantages of the related art.

An object of the present invention is to provide a method and apparatus for controlling current of an OLED display device, which is able to accurately estimate the amount of current according to an input image and control current to converge upon a target current.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method of controlling current of an organic light emitting diode (OLED) display device includes a first step of determining a peak luminance corresponding to an average picture level (APL) of input data, a second step of outputting the peak luminance without change or the peak luminance to which a fed-back luminance control gain is applied, a third step of calculating an estimated total current value of each frame using a representative value of each of representative luminance values to which the peak luminance output in the second step is applied and the count of representative luminance values obtained through histogram analysis of the input data, a fourth step of comparing the estimated total current value and a target value to generate a luminance control gain, a fifth step of determining whether the luminance control gain is fed back depending on whether the estimated total current value converges upon the target value, a sixth step of feeding the luminance control gain, returning to the second step and repeatedly performing the second step to the fifth step, if the estimated total current value does not converge upon the target value, a seventh step of applying luminance control gains generated by repeatedly performing the second step to the fifth step and determining a final luminance gain if the estimated total current value converges upon the target value, and an eighth step of applying the final luminance gain to the peak luminance determined by the first step and determining a final peak luminance.

The third step may include converting a result of multiplying the peak luminance output in the second step and each of the representative luminance values into each representative current using a predetermined look-up table, counting the representative luminance values through luminance average histogram analysis of the input data and outputting the count of representative luminance values, and multiplying each representative luminance current and the count of representative luminance values, summing all the multiplied results and calculating a total current value.

The fifth step may include proceeding to the sixth step of feeding the luminance control gain back if a difference between the estimated total current value and the target value exceeds a predetermined threshold and proceeding to the seventh step of determining the final luminance gain if the difference is within the predetermined threshold.

The fifth step may include proceeding to the sixth step of feeding the luminance control gain back if the number of feedbacks of the luminance control gain is less than a predetermined value and proceeding to the seventh step of determining the final luminance gain if the number of feedbacks becomes equal to the predetermined value. The fifth step may restrict the number of feedback to an odd value.

The first to the eight steps may be performed in a vertical blank period of each frame.

In another aspect of the present invention, an apparatus for controlling current of an organic light emitting diode (OLED) display device includes a current controller for estimating a total current value using a peak luminance corresponding to an average picture level (APL) of input data and a histogram analysis result of the input data, comparing an estimated total current value and a target value to generate a luminance control gain, feeding the luminance control gain back and repeatedly performing an operation for estimating the total current value and generating the luminance control gain to determine a final luminancegain, and applying the final luminance gain to the peak luminance to determine a final peak luminance, a gamma voltage generator for adjusting a maximum gamma voltage in response to the final peak luminance determined by the current controller and dividing the adjusted maximum gamma voltage to generate and output a gamma voltage set, and a data driver for converting the input data into an analog data signal using the gamma voltage set generated by the gamma voltage generator and supplying the analog data signal to a display panel.

The current controller may include a peak luminance controller for determining the peak luminance corresponding to the APL of the input data, a peak luminance corrector for outputting the peak luminance without change or the peak luminance to which a fed-back luminance control gain is applied, a current estimator for calculating an estimated total current value of each frame using a representative current value per representative luminance value, to which the peak luminance output from the peak luminance corrector is applied, and the count of representative luminance values obtained through histogram analysis of the input data, a luminance control gain generator for comparing the estimated total current and a target value to generate a luminance control gain, a feedback controller for controlling a feedback of the luminance control gain depending on whether the estimated total current value converges upon the target value, feeding the luminance control gain back to the peak luminance corrector and repeatedly performing the operation by the peak luminance corrector, the current estimator and the luminance control gain generator if the estimated total current value does not converge upon the target value, and applying all luminance control gains generated by repeatedly performing the operation to determine the final luminance gain if the estimated total current value converges upon the target value, and a final peak determination unit for applying the final luminance gain determined by the feedback controller to the peak luminance determined by the peak luminance controller and determining the final peak luminance.

The current estimator may include a representative current calculator for converting the result of multiplying the peak luminance output from the peak luminance corrector and each of the representative luminance values into each representative current value using a predetermined look-up table, an average histogram calculator for counting the representative luminance values through luminance average histogram analysis of the input data and outputting the count of representative luminance values, and a total current calculator for multiplying each representative current value and the count of representative luminance values, summing the multiplied results and calculating the total current value.

The representative current calculator may calculate the representative luminance value which is not stored in the look-up table and, to which the peak luminance is applied, by reading and interpolating current values of a representative luminance values adjacent to the representative luminance value.

The feedback controller may feed the luminance control gain back if a difference between the estimated total current value and the target value exceeds a predetermined threshold and determine the final luminance gain if the difference is within the predetermined threshold.

The feedback controller may feed the luminance control gain back if the number of feedbacks of the luminance control gain is less than a predetermined value and determine the final luminance gain if the number of feedbacks becomes equal to the predetermined value. The feedback controller may restrict the number of feedback to an odd value.

An operation for controlling the current by the current controller may be performed in a vertical blank period of each frame.

The method and apparatus for controlling current of the OLED display device according to the embodiment of the present invention estimates the total current value using the histogram analysis result and the peak luminance according to the APL of the input data, compares the estimated total current value and the target value, generates the luminance control gain, adjusts the final peak luminance according to the luminance control gain, and adjusts the gamma voltage by the gamma voltage generator according to the final peak luminance, thereby controlling current of the display panel.

In particular, the method and apparatus for controlling current of the OLED display device according to the embodiment of the present invention repeatedly performs total current estimation and luminance control gain calculation through luminance control gain feedback such that the estimated total current value converges upon the target value, thereby improving current estimation and control accuracy.

In the method and apparatus for controlling current of the OLED display device according to the embodiment of the present invention, when the total current value is estimated, since only the representative current values corresponding to the representative values to which the input peak luminance is applied are calculated, the representative current values and the count of the representative values are multiplied and the multiplied results are summed to calculate the total current value, it is possible to rapidly calculate the total current value in synchronization with the peak luminance output per frame. Therefore, it is possible to perform the operation within the vertical blank period even when total current value estimation and luminance control gain generation are repeated.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Reference will now be made in detail to embodiments of the present invention, examples of which are illustrated in FIGS. 1 to 7.

Figure 1:
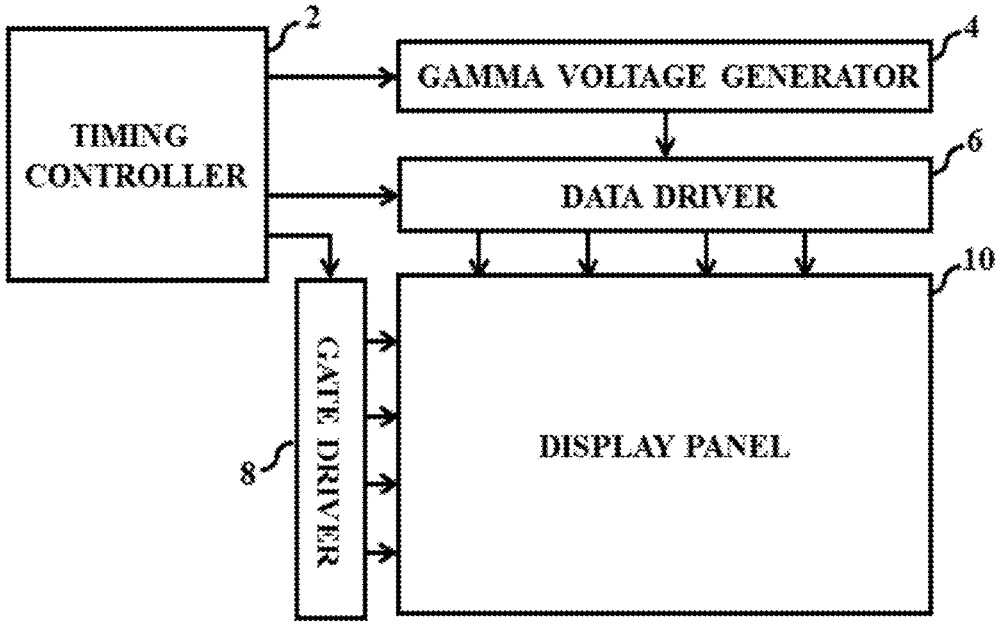
FIG. 1 is a schematic block diagram showing an OLED display device for controlling current according to one embodiment.

FIG. 1 is a schematic block diagram showing an OLED display device for controlling current according to one embodiment.

The OLED display device shown in FIG. 1 includes a timing controller 2, a gamma voltage generator 4, a data driver 6, a gate driver 8, and a display panel 10.

The timing controller 2 generates and outputs a data control signal and a gate control signal for respectively controlling driving timings of the data driver 6 and the gate driver 8 and modulates input data using various data modulation methods for image quality improvement and outputs the modulated input data to the data driver 6.

In order to reduce power consumption, the timing controller 2 determines a peak luminance according to input data, estimates a total current value, adjusts a peak luminance according to a luminance control gain using the estimated total current value, and outputs the adjusted peak luminance to the gamma voltage generator 4 as a final peak luminance. The gamma voltage generator 4 adjusts a gamma voltage according to the final peak luminance from the timing controller 2, thereby controlling current of the display panel 10.

The timing controller 2 determines the peak luminance according to an average picture level (APL) of the input data, estimates the total current value using a histogram analysis result of the input data and the peak luminance, compares the estimated total current value with a target value, and generates the luminance control gain. In addition, the timing controller 2 feeds the luminance control gain back and repeatedly performs an operation for estimating the total current value and calculating the luminance control gain, such that the estimated total current value converges upon the target value. The timing controller 2 calculates a final luminance gain using all luminance control gains generated by repeatedly performing the operation, adjusts the peak luminance according to the final luminance gain, and outputs the adjusted peak luminance as the final peak luminance.

The timing controller 2 performs the operation for estimating the total current value according to the input data and calculating the luminance control gain in a vertical blank time of each frame, in which data is not received. Thus, a separate operation time for controlling current is not required. The timing controller 2 will be described in detail below.

The gamma voltage generator 4 generates and supplies a gamma voltage set including a plurality of gamma voltages having different levels to the data driver 6. The gamma voltage generator 4 adjusts a maximum gamma voltage (high gamma voltage) in correspondence with the final peak luminance supplied from the timing controller 2, divides the adjusted maximum gamma voltage through a resistor string, and generates and outputs the gamma voltage set including the plurality of gamma voltages.

The gamma voltage generator 4 includes a gamma voltage adjuster (not shown) for adjusting the maximum gamma voltage (high gamma voltage) in response to the final peak luminance from the timing controller 2 and resistor strings (not shown) connected in series between an input terminal of the maximum gamma voltage adjusted by the gamma voltage adjuster and ground. The gamma voltage generator 4 generates an independent gamma voltage set of each of red (R), green (G) and blue (B) using the resistor strings respectively corresponding to R, G and B or a common gamma voltage set using a common resistor string of RGB. In the gamma voltage generator 4, the maximum gamma voltage is adjusted in correspondence with the final peak luminance and the other gamma voltages which depend on the maximum gamma voltage are adjusted according to the maximum gamma voltage. Since the gamma voltages adjusted by the gamma voltage generator 4 are supplied as data signals of the pixels of the display panel 10 through the data driver 6 to control current supplied to each pixel, it is possible to control the current of the display panel 10 by adjusting the final peak luminance. Therefore, it is possible to reduce power consumption.

The data driver 6 converts digital data from the timing controller 2 into an analog data signal in response to the data control signal from the timing controller 2 and supplies the analog data signal to a plurality of data lines of the display panel 10. At this time, the data driver 6 divides the gamma voltage set from the gamma voltage generator 4 into grayscale voltages corresponding to grayscale values of data and converts the digital data into the analog data signal using the divided grayscale voltages.

The gate driver 8 sequentially drives a plurality of gate lines of the display panel 10 in response to the gate control signal from the timing controller 2. The gate driver 8 supplies a scan pulse of a gate on voltage to each gate line in a scan period in response to the gate control signal and supplies a gate off voltage in the remaining period.

The display panel 10 includes a pixel matrix in which a plurality of red (R), green (G) and blue (B) subpixels connected to a data line, a gate line, a high voltage line and a low voltage line are arranged in a matrix. Each subpixel includes an OLED element and a pixel circuit to drive the OLED element. The pixel circuit includes at least a switching transistor, a driving transistor, and a storage capacitor. The switching transistor charges the storage capacitor with a voltage corresponding to a data signal in response to the scan pulse from the gate line and the driving transistor controls current supplied to the OLED element according to the voltage charged in the storage capacitor so as to adjust the amount of light emitted by the OLED element. The amount of light emitted by the OLED element is proportional to the current supplied from the driving transistor.

Figure 2:
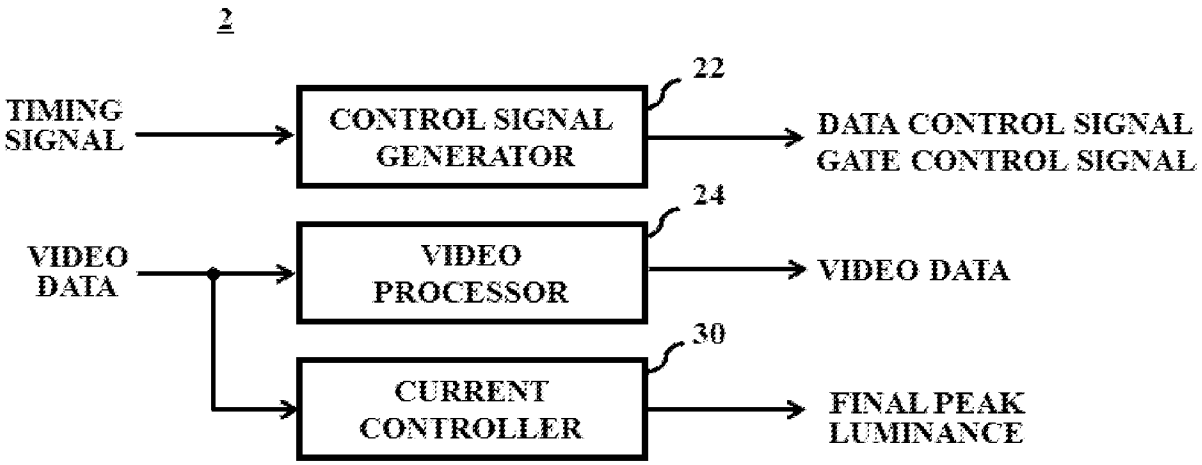
FIG. 2 is a block diagram showing a timing controller shown in FIG. 1 according to one embodiment.
Figure 3:
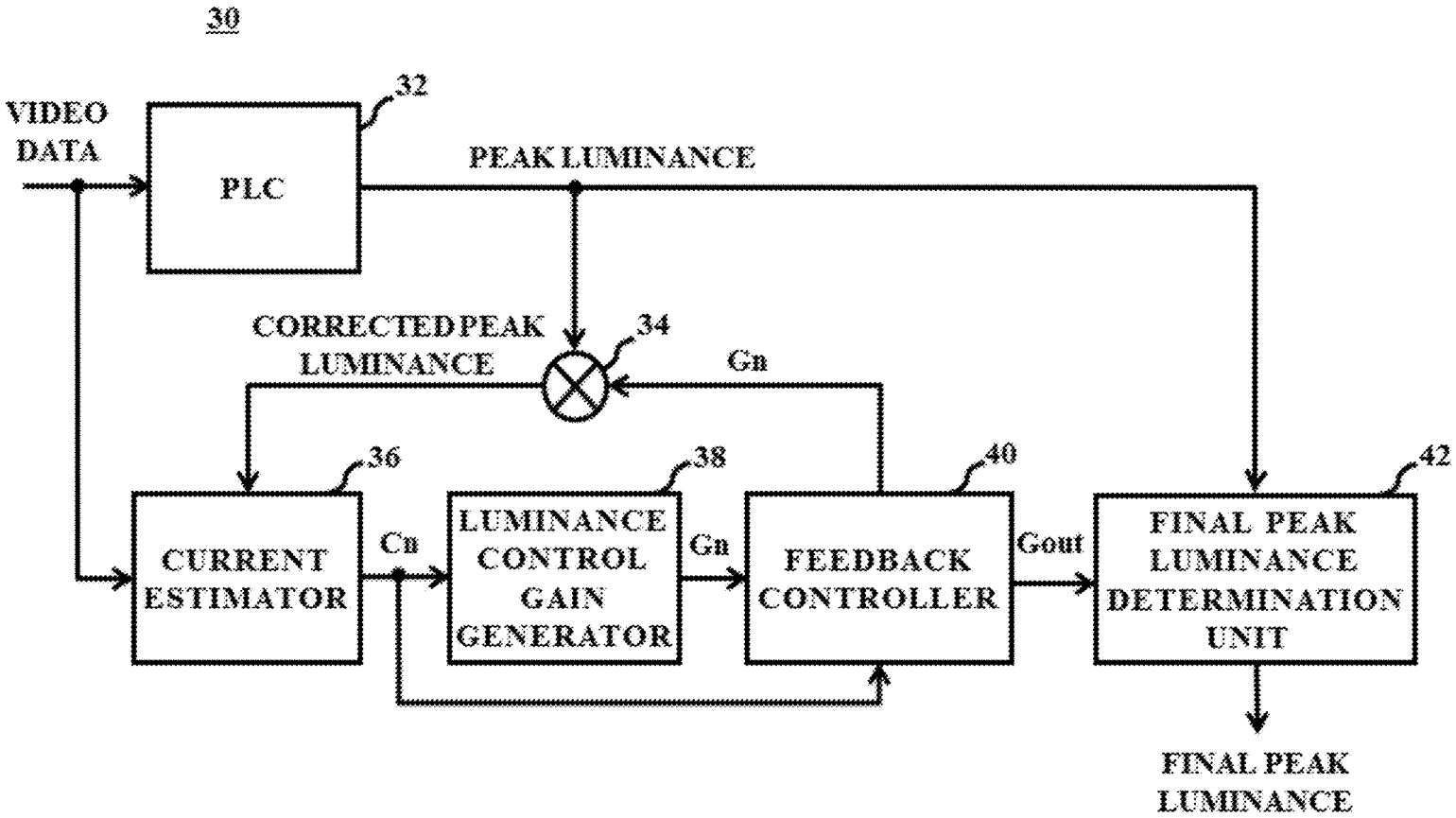
FIG. 3 is a block diagram showing a current controller shown in FIG. 2 according to one embodiment.

FIG. 2 is a block diagram showing the timing controller 2 shown in FIG. 1 according to one embodiment, and FIG. 3 is a block diagram showing a current controller 30 shown in FIG. 2 according to one embodiment.

The timing controller 2 shown in FIG. 2 includes a control signal generator 22, a video processor 24, and a current controller 30.

The control signal generator 22 generates and outputs a data control signal and a gate control signal for respectively controlling driving timings of the data driver 6 and the gate driver 8 using a timing signal including a dot clock (not shown), a data enable signal (not shown), a horizontal sync signal (not shown), and a vertical sync signal (not shown) received from an external computer system.

The video processor 24 aligns the data received from the external computer system on the display panel 10 and outputs the data to the data driver 6. The video processor 24 modulates input video data using various data modulation methods including white balance adjustment for image quality improvement and outputs the modulated video data to the data driver 6.

The current controller 30 determines the peak luminance according to the input data, estimates a total current value, controls the peak luminance according to a luminance control gain using the estimated total current value, and outputs the final peak luminance to the gamma voltage generator 4.

The current controller 30 determines the peak luminance according to an average picture level (APL) of the input data, estimates the total current value using a histogram analysis result of the input data and the peak luminance, compares the estimated total current value with the target value, and generates the luminance control gain. In addition, the current controller 30 feeds the luminance control gain back and repeatedly performs an operation for estimating the total current value and calculating the luminance control gain, such that the estimated total current value converges upon the target value. The current controller 30 calculates the final luminance gain using all luminance control gains generated by repeatedly performing the operation, adjusts the peak luminance according to the final luminance gain, and outputs the adjusted peak luminance as the final peak luminance.

As shown in FIG. 3, the current controller 30 includes a peak luminance controller (PLC) 32, a peak luminance corrector 34, a current estimator 36, a luminance control gain generator 38, a feedback controller 40, and a final peak luminance determination unit 42.

The PLC 32 detects the number of pixels having a peak luminance in one frame from the input video data, that is, the APL indicating an area occupied by white pixels on one screen, and determines and outputs the peak luminance according to the detected APL. The PLC 32 determines and outputs the peak luminance corresponding to the detected APL using a look-up table (LUT) in which an APL curve of a predetermined APL function or a peak luminance corresponding to an APL is previously set. In order to control current consumption, the peak luminance is set to be inversely proportional to the APL. That is, a relatively small peak luminance is set as the APL is increased (brighter image) and a relatively large peak luminance is set as the APL is decreased (darker image). The PLC 32 normalizes the peak luminance so as to represent a ratio of a peak luminance value to a reference peak luminance value and outputs the normalized peak luminance. The following peak luminance is the normalized peak luminance.

The peak luminance corrector 34 multiplies the peak luminance from the PLC 32 with the luminance control gain fed back from the feedback controller 40 to correct the peak luminance and outputs the corrected peak luminance to the current estimator 36. The peak luminance corrector 34 regards the luminance control gain as 1 if the luminance control gain is not fed back from the feedback controller 40 and outputs the peak luminance from the PLC 32 to the current estimator 36 without correction.

The current estimator 36 counts the representative luminance values through the histogram analysis of the input data, calculates a representative current value of each of the representative luminance values to which the input peak luminance is applied, sums the results of multiplying the representative current value by the count of representative luminance values, calculates a total current value per frame, and outputs the calculated total current value as an estimated total current value Cn (n being a natural number).

The luminance control gain generator 38 compares the estimated total current value Cn supplied from the current estimator 36 with a predetermined target value Ct so as to generate a luminance control gain Gn. That is, the luminance control gain generator 38 calculates a ratio (Ct/Cn) of the target value Ct to the estimated total current value Cn to generate the luminance control gain Gn.

The feedback controller 40 determines whether the estimated total current value Cn from the current estimator 36 converges upon the target value Ct and feeds the luminance control gain Gn back to the peak luminance corrector 34 or determines and outputs a final luminance control gain Gout. The feedback controller 40 determines that the estimated total current value Cn does not converge upon the target value Ct if a difference between the estimated total current value Cn and the target value Ct exceeds a threshold ±TH and feeds the luminance control gain Gn back to the peak luminance corrector 34. The feedback controller 40 determines that the estimated total current value Cn converges upon the target value Ct if a difference between the estimated total current value Cn and the target value Ct is within the threshold ±TH, applies (e.g., multiplies) the generated luminance control gains Gn and determines the final luminance gain Gout.

The number of feedbacks of the luminance control gain is predetermined in the feedback controller 40, the luminance control gain Gn is fed back if the number of feedbacks is less than the predetermined number and the final luminance gain Gout is determined if the number of feedbacks becomes equal to the predetermined number.

If the luminance control gain Gn is fed back from the feedback controller 40, the peak luminance corrector 34 applies the fed-back luminance control gain Gn to the peak luminance to correct the peak luminance, the current estimator 36 calculates the current value using the corrected peak luminance again to re-calculate the estimated total current value, the luminance control gain generator 38 compares the re-calculated estimated total current value with the target value to regenerate the luminance control gain, and the feedback controller 40 determines whether the re-calculated estimated total current value converges upon the target value or whether the number of feedbacks is equal to the predetermined value and repeats the feedback or determines the final luminance gain Gout according to the determined result. If the number of feedbacks of the luminance control gain Gn by the feedback controller 40 is n, n luminance control gains Gn generated by performing the operation n times by the luminance control gain generator 38 are multiplied to determine the final luminance gain Gout (Gout=G1×G2× . . . ×Gn).

For example, a first estimated total current value C1 and a first luminance control gain G1 (=Ct/C1) are calculated by performing a first operation using the current estimator 36 and the luminance control gain generator 38. If the feedback controller 40 feeds the first luminance control gain G1 back, the current estimator 36 and the luminance control gain generator 38 calculate a second estimated total current value C2 and a second luminance control gain G2 (=Ct/C2) by a second operation. Accordingly, the current estimator 36 and the luminance control gain generator 38 perform an n-th operation by an (n−1)-th (n being a natural number) feedback such that an n-th estimated total current value converges upon the target value Ct. At this time, the feedback controller 40 multiplies all the first to n-th luminance control gains G1 to Gn to determine the final luminance gain Gout (Gout=G1×G2× . . . ×Gn).

Figure 4:
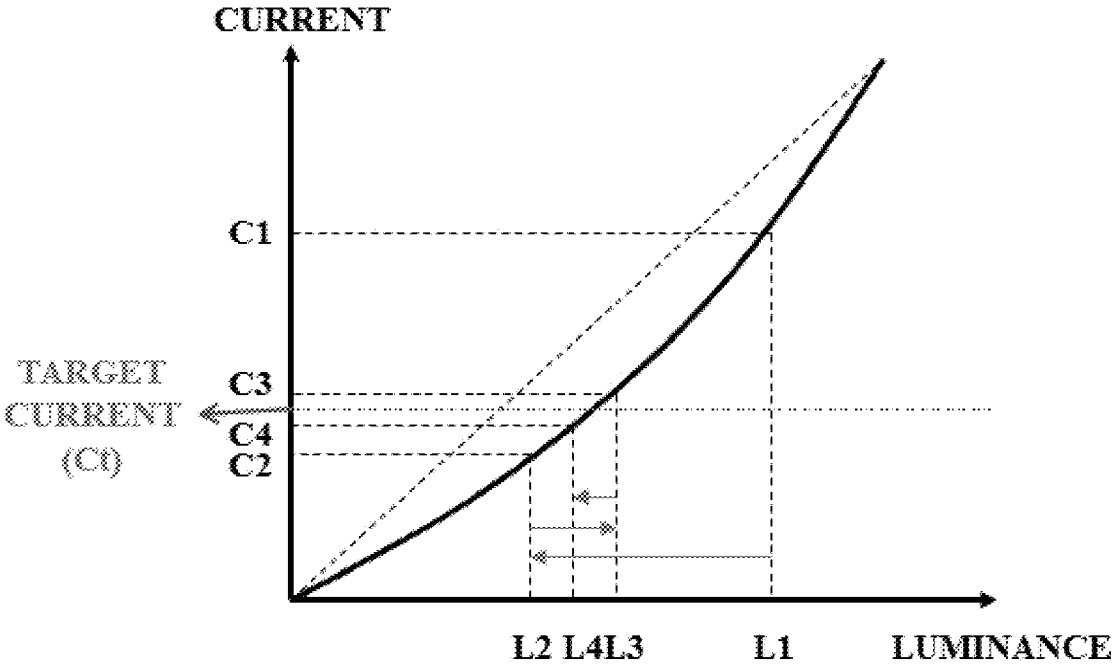
FIG. 4 is a graph illustrating a process of enabling an estimated total current value to converge upon a target value by repeatedly performing an operation in the current controller shown in FIG. 2.

For example, it can be seen from FIG. 4 that the fourth estimated total current value C4 close to the target value Ct is calculated by performing the operation four times using the current estimator 36 and the luminance control gain generator 38 based on three feedbacks by the feedback controller 40.

In FIG. 4, the estimated total current value obtained by the first operation, which is greater than the target value Ct, is decreased to be less than the target value Ct by a second operation (first feedback), is increased to be greater than the target value Ct by a third operation (second feedback) and is decreased to be less than the target value Ct by a fourth operation (third feedback), such that the estimated total current value converges upon the target value Ct. Since the estimated total current value is alternately decreased and increased to be less and greater than the target value Ct as the number of feedbacks is increased, a difference between the estimated value and the target value Ct is decreased. In terms of power consumption, the case in which the estimated total current value is less than the target value Ct is more preferable than the case in which the estimated total current value exceeds the target value Ct. Therefore, the number of feedbacks by the feedback controller 40 is preferably set to an odd value.

The final peak luminance determination unit 42 multiplies the final luminance gain Gout from the feedback controller 40 by the peak luminance from the PLC to determine the final peak luminance and outputs the final peak luminance to the gamma voltage generator 4.

Figure 5:
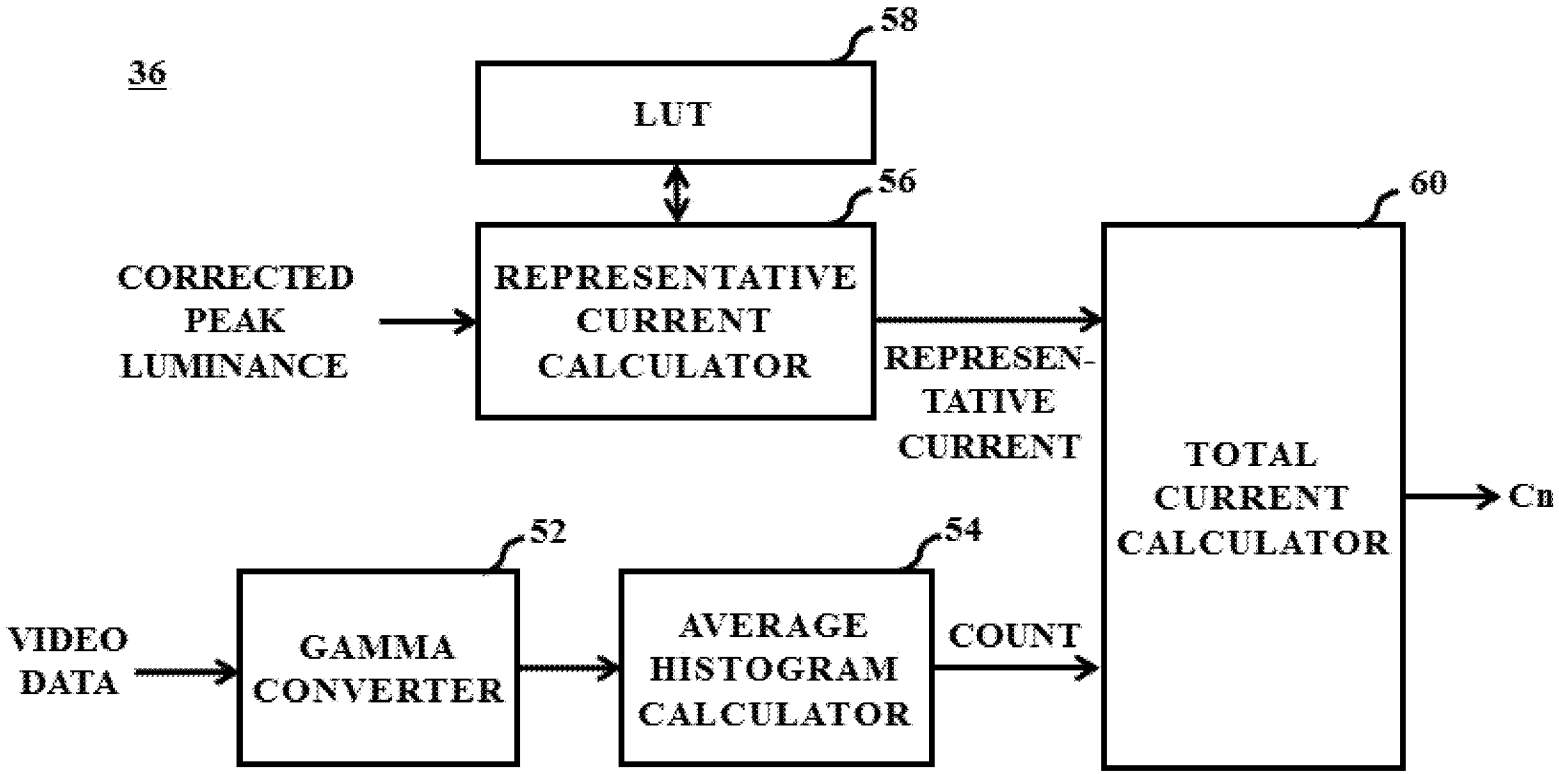
FIG. 5 is a block diagram showing a current estimator shown in FIG. 3 according to one embodiment.

FIG. 5 is a block diagram showing the current estimator 36 shown in FIG. 3 according to one embodiment.

The current estimator 36 shown in FIG. 5 includes a gamma converter 52, an average histogram calculator 54, a representative current calculator 56, a LUT 58, and a total current calculator 60.

The gamma converter 52 performs gamma conversion upon input video data according to characteristics of the OLED display device and outputs the gamma-converted video data.

The average histogram calculator 54 converts the gamma-converted data from the gamma converter 52 into luminance data, analyzes a luminance average histogram in frame units, counts representative values (maximum values) of a plurality of luminance sections, and outputs the count of representative values. For example, the average histogram calculator 54 divides a sum of luminance data of a predetermined section by each representative value and counts and outputs the frequency in which the sum of the luminance data exceeds each representative value per representative value.

The representative current calculator 56 adjusts the representative luminance values of the histogram according to the input peak luminance, converts the adjusted representative luminance values into representative current values using the LUT 58 and outputs the representative current value. Current corresponding to each luminance value is predetermined and stored in the LUT 58 through a luminance-current conversion function. The representative current calculator 56 multiplies the representative luminance values by the input peak luminance to adjust the representative luminance values according to the peak luminance and reads and outputs the representative current value corresponding to each of the adjusted representative values in the LUT 58. In the LUT 58, all current values corresponding to all luminance values may be set and stored or only current values corresponding to some luminance values separated from each other at a predetermined interval may be set and stored. If only the current values corresponding to some luminance values are stored in the LUT 58, the representative current calculator 56 may read current values corresponding to two luminance values adjacent to the adjusted representative value from the LUT 58 and interpolates the read current values to calculate and output the current value corresponding to the adjusted representative value.

The total current calculator 60 multiplies the representative current values from the representative current calculator 56 per representative value and the count of representative values from the average histogram calculator 54, sums the multiplied results, and outputs the estimated total current value Cn of the corresponding frame.

Since the current estimator 36 calculates the representative current values corresponding to the representative values to which the input peak luminance is applied, multiples the representative current values and the count of the representative values and sums the multiplied results to calculate the total current value, it is possible to rapidly calculate the total current value in synchronization with the peak luminance output per frame. The current estimator 36 repeatedly calculates the representative current values and the total current value according to the corrected peak luminance when the total current value is repeatedly calculated by the feedback operation of the feedback controller 40 and the histogram analysis result applied to the first operation is used without change, it is possible to rapidly perform repeated calculation of the total current value.

As a result, the current controller 30 shown in FIG. 3 can perform the operation within the vertical blank period even when total current value estimation and luminance control gain generation are repeated.

Figure 6:
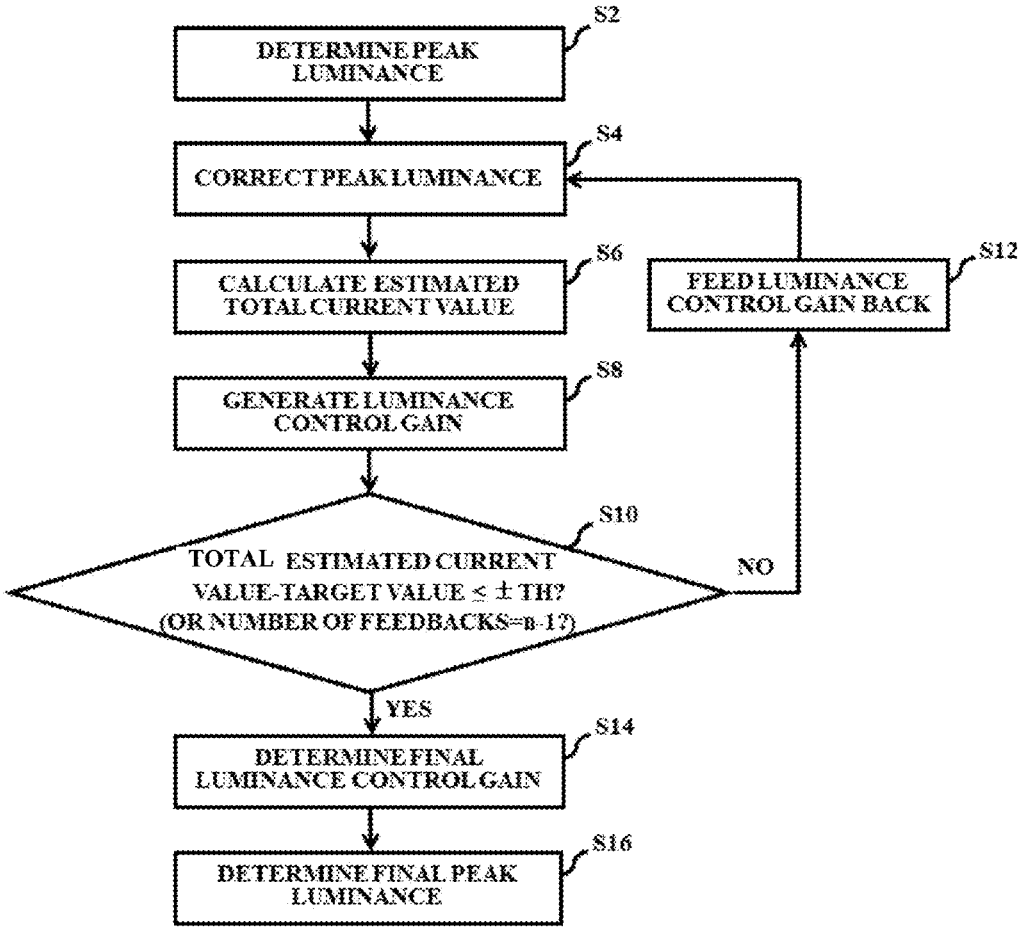
FIG. 6 is a flowchart illustrating a method of controlling current of an OLED display device according to one embodiment.

FIG. 6 is a flowchart illustrating a method of controlling current of an OLED display device according to one embodiment. Since the flowchart of FIG. 6 is performed by the current controller 30 shown in FIG. 3, a description will be given with reference to FIG. 3.

In step 2 (S2), the PLC 32 detects the APL from the input video data in frame units and determines and outputs peak luminance according to the detected APL.

In step 4 (S4), the peak luminance corrector 34 multiples the peak luminance from the PLC 32 by the luminance control gain fed back from the feedback controller 40 to correct the peak luminance and outputs the corrected peak luminance. The peak luminance corrector 34 regards the luminance control gain as 1 if the luminance control gain is not fed back from the feedback controller 40 and outputs the peak luminance without correction.

In step 6 (S6), the current estimator 36 counts the representative luminance values through the histogram analysis of the input data, calculates the representative current value per representative luminance value to which the input peak luminance is applied, sums the results of multiplying the representative current by the count of representative values, calculates a total current value per frame, and outputs the calculated total current value as an estimated total current value Cn (n being a natural number).

In step 8 (S8), the luminance control gain generator 38 calculates the ratio (Ct/Cn) of the target value Ct to the estimated total current value Cn using the estimated total current value Cn supplied from the current estimator 36 and a predetermined target value Ct so as to generate the luminance control gain Gn.

In step 10 (S10), the feedback controller 40 determines whether the estimated total current value Cn from the current estimator 36 converges upon the target value Ct and proceeds to step 12 (S12) of feeding the luminance control gain Gn back to return to step 4 (S4) or proceeds to step 14 (S14) to determine and output the final luminance control gain Gout according to the determined result. The feedback controller 40 determines that the estimated total current value Cn does not converge upon the target value Ct if the difference between the estimated total current value Cn and the target value Ct exceeds a threshold ±TH, feeds the luminance control gain Gn back to the peak luminance corrector 34 in step 12 (S12), and returns to step 4 (S4) to repeatedly perform steps 4 (S4) to 10 (S10). The feedback controller 40 determines that the estimated total current value Cn converges upon the target value Ct if a difference between the estimated total current value Cn and the target value Ct is within the threshold ±TH, and proceeds to step 14 (S14) to determine the final luminance gain Gout.

Alternatively, if the number of feedbacks is less than the predetermined number in step 10 (S10), the feedback controller 40 may determine that the estimated total current value Cn does not converge upon the target value Ct, feeds the luminance control gain Gn in step 12 (S12) and returns to step 4 (S4). If the number of feedbacks is equal to the predetermined number, the feedback controller 40 may determine that the estimated total current value Cn converges upon the target value Ct, and proceeds to step 14 (S14) to determine the final luminance gain Gout.

In step 10 (S10), if steps 4 (S4) to steps 10 (S10) are performed n times by feeding the luminance control gain back n−1 times by the feedback controller 40 and then step 14 (S14) is performed, the feedback controller 40 multiples all the first to n-th luminance control gains obtained by n−1 feedbacks to determine the final luminance gain Gout.

In step 16 (S16), the final peak luminance determination unit 42 multiplies the final luminance gain Gout from the feedback controller 40 by the peak luminance from the PLC 32 to determine the final peak luminance and supplies the determined final peak luminance to the gamma voltage generator 4. Then, the gamma voltage generator 4 adjusts the gamma voltage according to the final peak luminance to control current of the display panel 10.

Figure 7A:
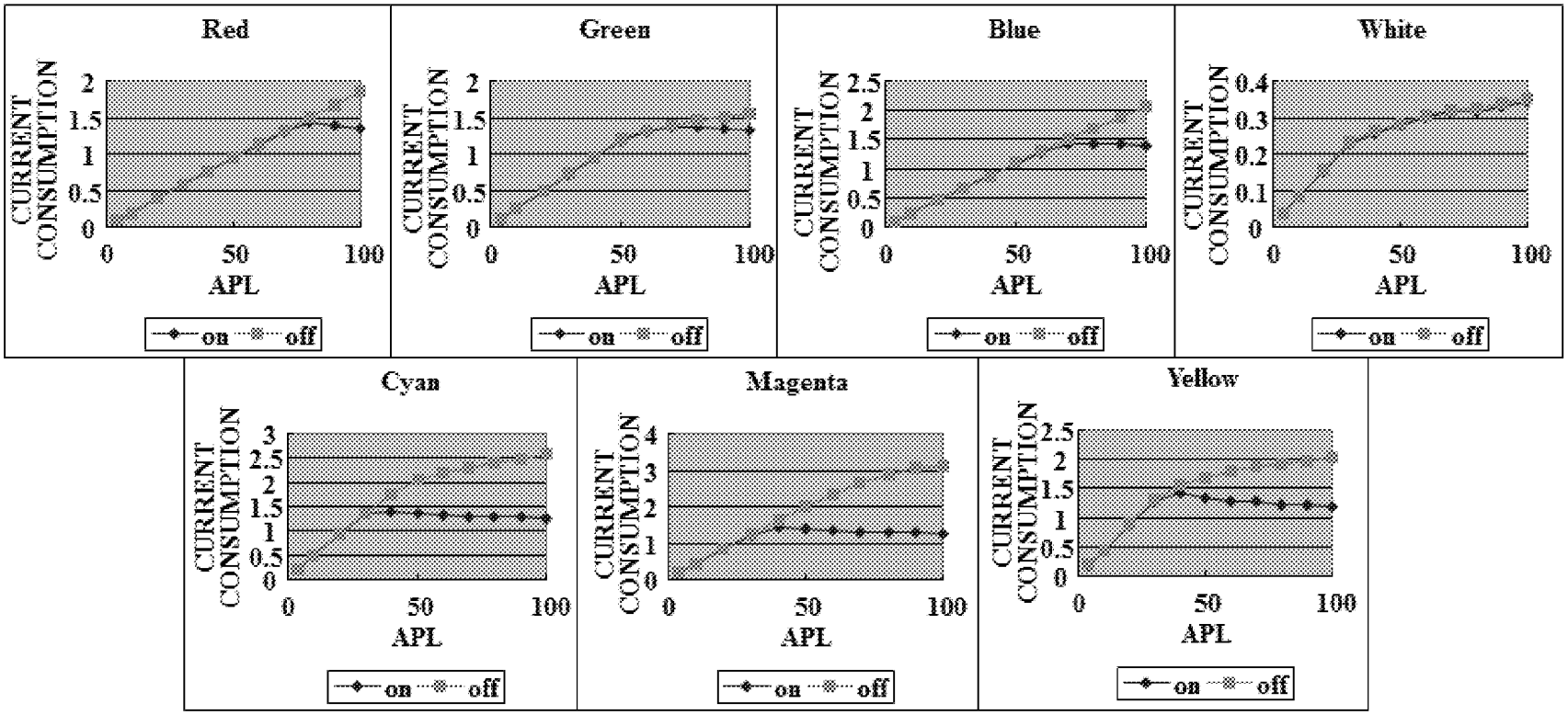
FIGS. 7A and 7B are graphs showing current consumption reduction according to image patterns by controlling current of an OLED display device according to one embodiment.
Figure 7B:
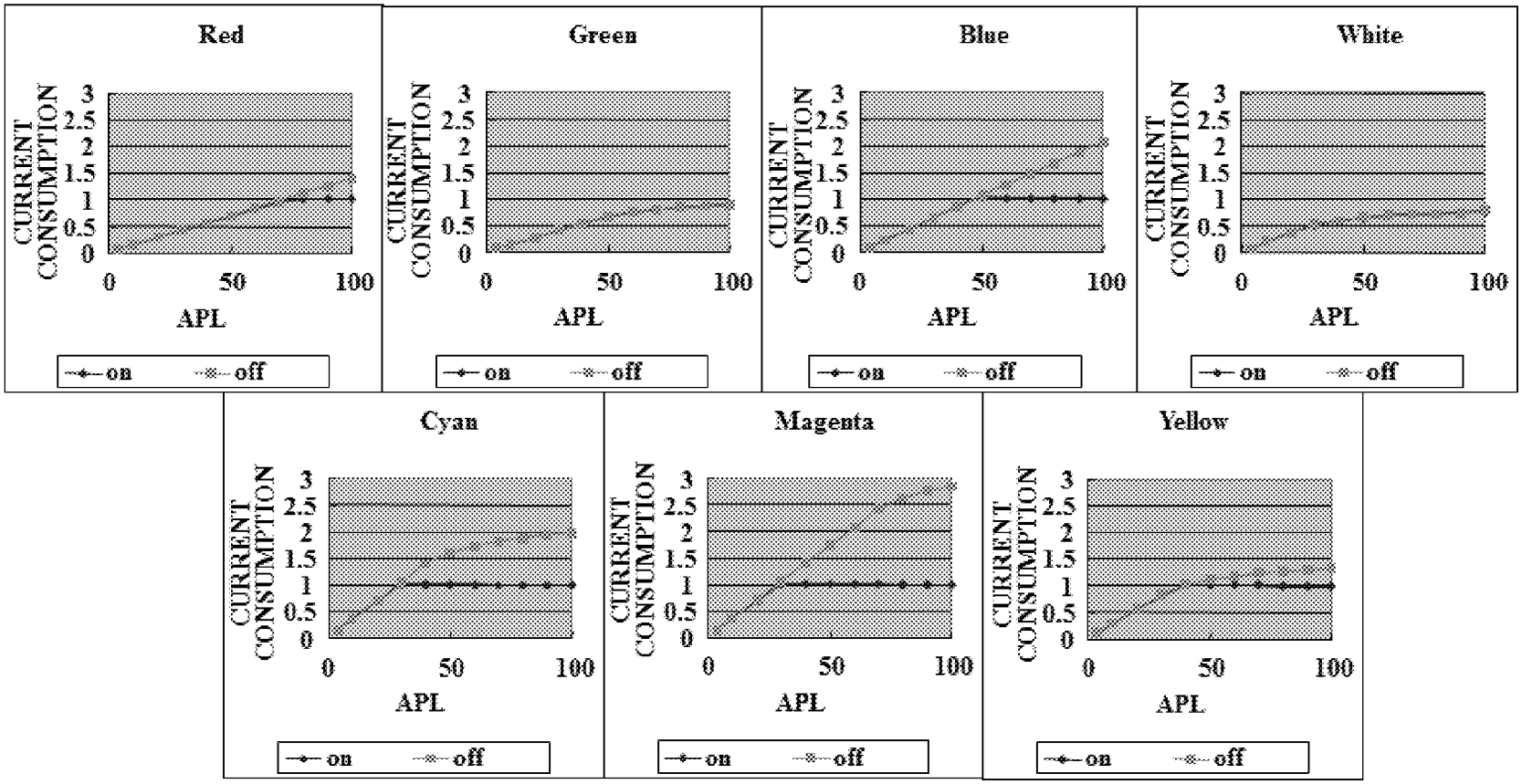

FIGS. 7A and 7B are graphs showing current consumption reduction according to image patterns by controlling current of an OLED display device.

FIG. 7A is a graph showing current consumption vs. APL when the current controller 30 of the OLED display device according to the embodiment of the present invention performs current control one time and FIG. 7B is a graph showing current consumption vs. APL when the current controller 30 of the OLED display device according to the embodiment of the present invention performs current control three times, with respect to red (R), green (G), blue (B), white (W), cyan (C), magenta (M) and yellow video patterns.

Referring to FIG. 7A, current consumption is increased as the APL is increased if current control is not performed (off) but current converges upon target current 1.5 A to be saturated as the APL is increased if current control is performed one time (on).

Referring to FIG. 7B, current consumption is increased as the APL is increased if current control is not performed (off) but current converges upon target current 1.5 A to be saturated as the APL is increased if current control is performed three times (on).

While a difference between the target current and the maximum consumed current is about 20% if current control is performed one time, a difference between the target current and the maximum consumed current is about 4.3% if current control is performed three times. Thus, current control accuracy is improved.

The method and apparatus for controlling current of the OLED display device according to the embodiment of the present invention estimates the total current value using the histogram analysis result and the peak luminance according to the APL of the input data, compares the estimated total current value and the target value, generates the luminance control gain, adjusts the final peak luminance according to the luminance control gain, and adjusts the gamma voltage by the gamma voltage generator according to the final peak luminance, thereby controlling current of the display panel.

In particular, the method and apparatus for controlling current of the OLED display device according to the embodiment of the present invention repeatedly performs total current estimation and luminance control gain calculation through luminance control gain feedback such that the estimated total current value converges upon the target value, thereby improving current estimation and control accuracy.

In the method and apparatus for controlling current of the OLED display device according to the embodiment of the present invention, when the total current value is estimated, since only the representative current values corresponding to the representative values to which the input peak luminance is applied are calculated, the representative current values and the count of the representative values are multiplied and the multiplied results are summed to calculate the total current value, it is possible to rapidly calculate the total current value in synchronization with the peak luminance output per frame. Therefore, it is possible to perform the operation within the vertical blank period even when total current value estimation and luminance control gain generation are repeated.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of controlling current of an organic light emitting diode (OLED) display device, the method comprising:

a first step of determining a peak luminance corresponding to an average picture level (APL) of input data;

a second step of outputting the peak luminance without change or the peak luminance to which a fed-back luminance control gain is applied;

a third step of calculating an estimated total current value of each frame using a representative value of each of representative luminance values to which the peak luminance output in the second step is applied and the count of representative luminance values obtained through histogram analysis of the input data;

a fourth step of comparing the estimated total current value and a target value to generate a luminance control gain;

a fifth step of determining whether the luminance control gain is fed back depending on whether the estimated total current value converges upon the target value;

a sixth step of feeding the luminance control gain, returning to the second step and repeatedly performing the second step to the fifth step, if the estimated total current value does not converge upon the target value;

a seventh step of applying luminance control gains generated by repeatedly performing the second step to the fifth step and determining a final luminance gain if the estimated total current value converges upon the target value; and an eighth step of applying the final luminance gain to the peak luminance determined by the first step and determining a final peak luminance.

2. The method according to claim 1, wherein the third step includes:

converting a result of multiplying the peak luminance output in the second step and each of the representative luminance values into each representative current using a predetermined look-up table;

counting the representative luminance values through luminance average histogram analysis of the input data and outputting the count of representative luminance values; and multiplying each representative current and the count of representative luminance values, summing all multiplied results and calculating a total current value.

3. The method according to claim 1, wherein the fifth step includes proceeding to the sixth step of feeding the luminance control gain back if a difference between the estimated total current value and the target value exceeds a predetermined threshold and proceeding to the seventh step of determining the final luminance gain if the difference is within the predetermined threshold.

4. The method according to claim 3, wherein the fifth step restricts a number of feedbacks of the luminance control gain to an odd value.

5. The method according to claim 4, wherein the fifth step includes proceeding to the sixth step of feeding the luminance control gain back if the number of feedbacks of the luminance control gain is less than a predetermined value and proceeding to the seventh step of determining the final luminance gain if the number of feedbacks becomes equal to the predetermined value.

6. The method according to claim 5, wherein the fifth step restricts the number of feedbacks to an odd value.

7. The method according to claim 1, wherein the first to the eight steps are performed in a vertical blank period of each frame.

8. An apparatus for controlling current of an organic light emitting diode (OLED) display device, the apparatus comprising:

a current controller for estimating a total current value using a peak luminance corresponding to an average picture level (APL) of input data and a histogram analysis result of the input data, comparing an estimated total current value and a target value to generate a luminance control gain, feeding the luminance control gain back and repeatedly performing an operation for estimating the total current value and generating the luminance control gain to determine a final luminance gain, and applying the final luminance gain to the peak luminance to determine a final peak luminance;

a gamma voltage generator for adjusting a maximum gamma voltage in response to the final peak luminance determined by the current controller and dividing the adjusted maximum gamma voltage to generate and output a gamma voltage set; and a data driver for converting the input data into an analog data signal using the gamma voltage set generated by the gamma voltage generator and supplying the analog data signal to a display panel.

9. The apparatus according to claim 8, wherein the current controller includes:

a peak luminance controller for determining the peak luminance corresponding to the APL of the input data;

a peak luminance corrector for outputting the peak luminance without change or the peak luminance to which a fed-back luminance control gain is applied;

a current estimator for calculating an estimated total current value of each frame using a representative current value per representative luminance value, to which the peak luminance output from the peak luminance corrector is applied, and the count of representative luminance values obtained through histogram analysis of the input data;

a luminance control gain generator for comparing the estimated total current and a target value to generate a luminance control gain;

a feedback controller for controlling a feedback of the luminance control gain depending on whether the estimated total current value converges upon the target value, feeding the luminance control gain back to the peak luminance corrector and repeatedly performing the operation by the peak luminance corrector, the current estimator and the luminance control gain generator if the estimated total current value does not converge upon the target value, and applying all luminance control gains generated by repeatedly performing the operation to determine the final luminance gain if the estimated total current value converges upon the target value; and a final peak determination unit for applying the final luminance gain determined by the feedback controller to the peak luminance determined by the peak luminance controller and determining the final peak luminance.

10. The apparatus according to claim 9, wherein the current estimator includes:

a representative current calculator for converting the result of multiplying the peak luminance output from the peak luminance corrector and each of the representative luminance values into each representative current value using a predetermined look-up table;

an average histogram calculator for counting the representative luminance values through luminance average histogram analysis of the input data and outputting the count of representative luminance values; and a total current calculator for multiplying each representative current value and the count of representative luminance values, summing multiplied results and calculating the total current value.

11. The apparatus according to claim 10, wherein the representative current calculator calculates the representative luminance value which is not stored in the look-up table and, to which the peak luminance is applied, by reading and interpolating current values of a representative luminance values adjacent to the representative luminance value.

12. The apparatus according to claim 9, wherein the feedback controller feeds the luminance control gain back if a difference between the estimated total current value and the target value exceeds a predetermined threshold and determines the final luminance gain if the difference is within the predetermined threshold.

13. The apparatus according to claim 12, wherein the feedback controller restricts a number of feedbacks of the luminance control gain to an odd value.

14. The apparatus according to claim 13, wherein the feedback controller feeds the luminance control gain back if the number of feedbacks of the luminance control gain is less than a predetermined value and determines the final luminance gain if the number of feedbacks becomes equal to the predetermined value.

15. The apparatus according to claim 14, wherein the feedback controller restricts the number of feedbacks to an odd value.

16. The apparatus according to claim 9, wherein an operation for controlling the current by the current controller is performed in a vertical blank period of each frame.

* * * * *